US006398049B1

(12) United States Patent
Cote

(10) Patent No.: US 6,398,049 B1
(45) Date of Patent: Jun. 4, 2002

(54) FREE FLOW FORMULA CAP

(76) Inventor: Mary Cote, 11 Pilgrim Rd., Windham, NH (US) 03087

( * ) Notice: Subject to any disclaimer, the term of this patent is extended or adjusted under 35 U.S.C. 154(b) by 0 days.

(21) Appl. No.: 09/707,218

(22) Filed: Nov. 6, 2000

(51) Int. Cl.[7] ..... A61S 9/08
(52) U.S. Cl. ..... 215/11.6; 215/11.1
(58) Field of Search ..... 225/11.6, 11.1, 225/11.4, 11.5; 220/324, 315; 029/197

(56) References Cited

U.S. PATENT DOCUMENTS

| | | | | |
|---|---|---|---|---|
| 2,090,749 A | | 8/1937 | Corsi et al. | |
| 2,986,296 A | * | 5/1961 | Banishter et al. | 215/11 |
| 3,272,202 A | * | 9/1966 | Soto | 215/11.6 |
| 3,339,771 A | | 9/1967 | Ballin | |
| 3,468,445 A | | 9/1969 | Ballin | |
| 3,612,747 A | * | 10/1971 | Strohl, Jr. | 251/9 |
| 3,635,724 A | | 1/1972 | Schaar | |
| 4,934,542 A | | 6/1990 | Clark, Jr. | |
| 5,318,191 A | | 6/1994 | Pomales | |
| 5,704,500 A | | 1/1998 | Hoffman | |
| 5,948,003 A | | 9/1999 | Shefflin | |

* cited by examiner

*Primary Examiner*—Lee Young
*Assistant Examiner*—Lien Ngo
(74) *Attorney, Agent, or Firm*—Thomas E. Hagar

(57) ABSTRACT

A free flow formula cap comprising uniquely designed plugs to act as a passive sealing system for the nipple of a baby bottle. The plugs are retained within and at the bottom of the cap so that they align axially with the neck of the nipple when the cap is placed on the bottle. The plugs are operated from the exterior of the cap by depressing them together axially thereby pinching the nipple to create a seal between the end of the nipple and the bottle. The seal created by the plugs prevents the common problem of powder formula clogging the nipple during mixing of the same. The nipple remains sterile as one does not have to use her hands to unclog the nipple if the same were to get clogged during the mixing of the powdered formula.

3 Claims, 4 Drawing Sheets

FREE FLOW FORMULA CAP

BACKGROUND a) Field of the Invention

This invention relates to the industry of baby bottle caps that seal the nipple of the bottle. Presently, there are different types of nipple sealing devices. The designs range from using the cap itself to seal the nipple to using a mechanical means within the cap to seal the nipple. All the devices, however, permanently keep the nipple sealed while the cap is on the bottle.

b) Description of the Related Art

Presently there is a need for a device that can prevent the nipple of a baby bottle from becoming clogged during the mixing of powder baby formula. Quite often the nipple of a baby bottle is clogged with formula during the mixing of powder baby formula. The nipple must then be unclogged with one's fingers resulting in the nipple becoming unsterilized. The present invention prevents the nipple from being clogged during mixing, thereby preventing the need to be unclogged and also keeping the nipple sterile. None of the prior art directly relates to solving these needs.

In order to accomplish the task of preventing the nipple from clogging during the mixing of powder baby formula, a seal must be created between the nipple and the bottle cavity. Most of the prior art simply does not accomplish this task (see for example: U.S. Pat. Nos. 3,339,771, 3,468,445, and 5,704,500). The Pomales design (U.S. Pat. No. 5,318,191) does seal the nipple end from the bottle cavity. Unfortunately, this device has some drawbacks. First, it permanently maintains a seal on the nipple thereby shortening the life of the nipple. Second, the device involves complicated mechanical moving parts that increase the production costs and the likelihood of breakdown. Lastly, this device incorporates a mechanical spring action sealing means that it is operated from the top of a solid bottle cap.

The present invention fulfills the needs of the market concerns while at the same time overcomes the shortcomings of the prior art. It is a simple yet ingenious design consisting merely of a flexible cap containing two plugs located within and at the base of the cap. Unlike the Pomales design, the plugs are simple in design thereby limiting production costs and limiting the potential for breakage. Also, unlike all of the prior art the present device contains a passive sealing system that is only operated when needed thereby extending the life of the nipple and the invention.

SUMMARY OF THE INVENTION

The present invention is directed to an apparatus that satisfies the need for preventing a baby bottle nipple from being clogged during the mixing of baby formula while at the same time keeping the nipple sterile. The device is comprised of three components, namely: a baby bottle cap and two plugs. The plugs are contained within the cap and are located at its base. The cap is made of a flexible material and can be fitted to any standard baby bottle with a snug-fit or can be adapted to be used with the particular connecting device of the bottle, such as a screw top.

Once the cap is placed on the bottle, the plugs line up with the nipple without touching it (the passive system). When needed, the cap can be squeezed by simply pushing the two plugs axially towards each other. The effect is to pinch and seal the nipple. The end of the nipple is thereby sealed from the body of the bottle. Consequently, the nipple can not become clogged during the mixing of the formula.

Accordingly, one object of this invention is to provide a nipple sealing device which prevents the nipple from being clogged during the mixing of baby formula.

Another object of this invention is to keep the nipple of the bottle sterile during the mixing of the baby formula.

A third object of this invention is a passive clamping system which need only crimp the nipple during the operation of the system thereby extending the life of the nipple and the invention.

A fourth object of this invention is that it is inexpensive to manufacture, rugged in design, durable and contains few moving parts thereby decreasing the likelihood of failure.

A fifth object of this invention is that is user friendly, easy to operate and can be operated with one hand.

Other objects and advantages of this invention will become apparent from the following detailed description taken in conjunction with the accompanying drawings.

BRIEF DESCRIPTION OF THE DRAWINGS

These and other features, aspects and advantages of the present invention will become better understood with reference to the following description, appended claims, and accompanying drawings where.

DETAILED DESCRIPTION OF THE PREFERRED EMBODIMENT

Figure 1:
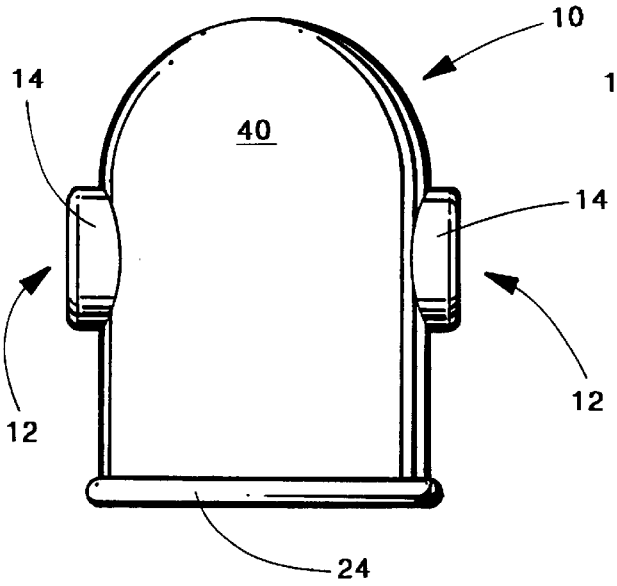
FIG. 1 is a front elevation view of the preferred embodiment of the invention.
Figure 2:
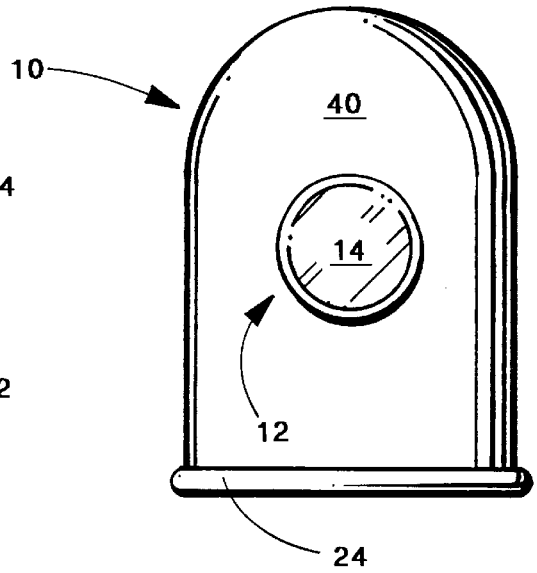
FIG. 2 is a side elevation view of the preferred embodiment of the invention.
Figure 3:
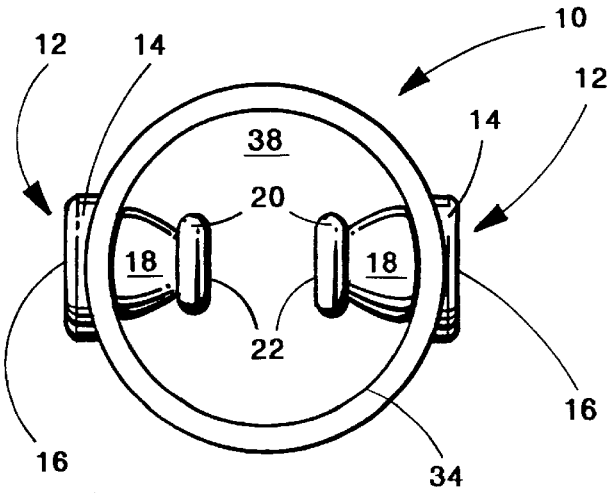
FIG. 3 is a plan view of the preferred embodiment of the invention.
Figure 4:
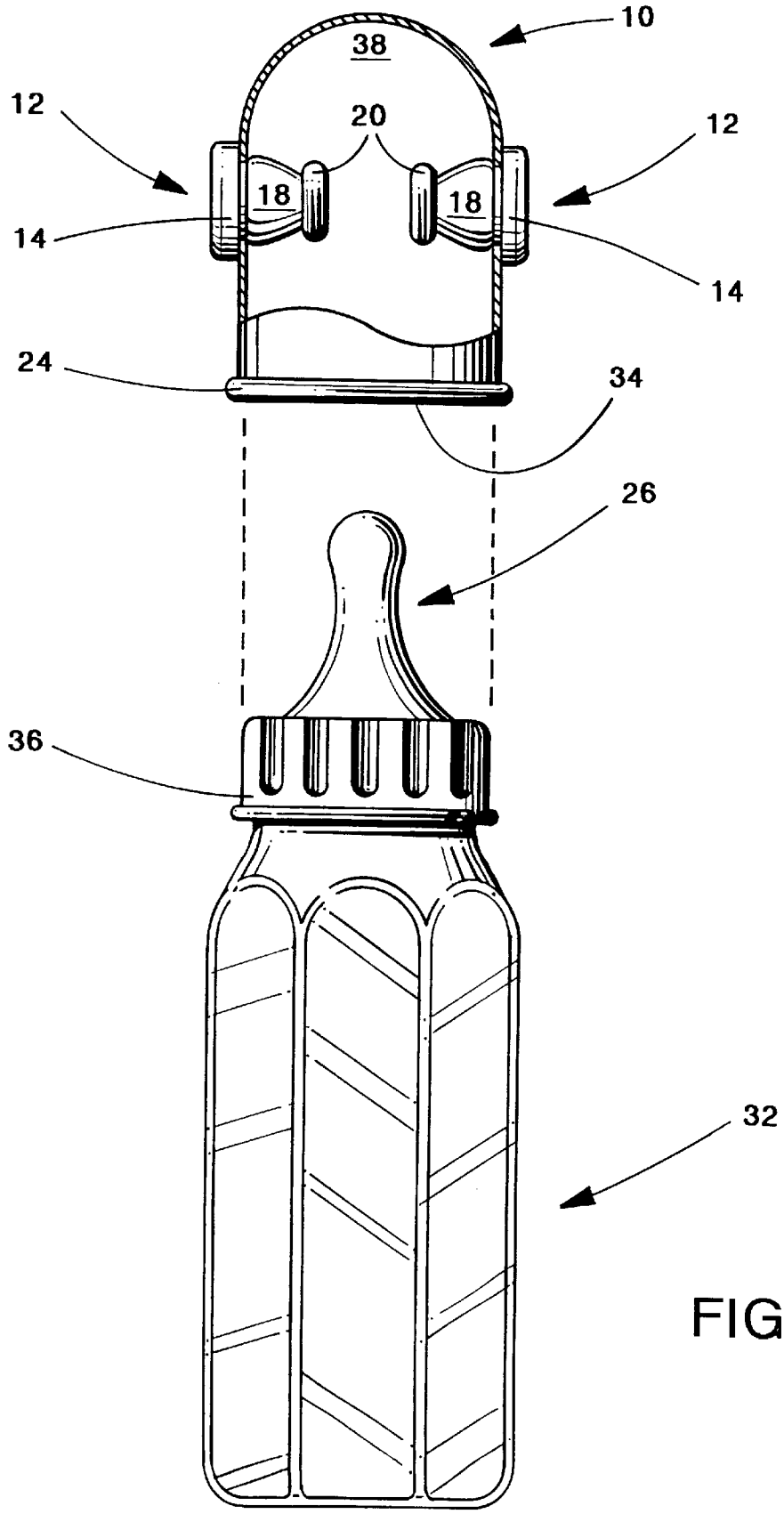
FIG. 4 is an exploded cut-away view of the preferred embodiment of the invention prior to its connection to a baby bottle.
Figure 6:
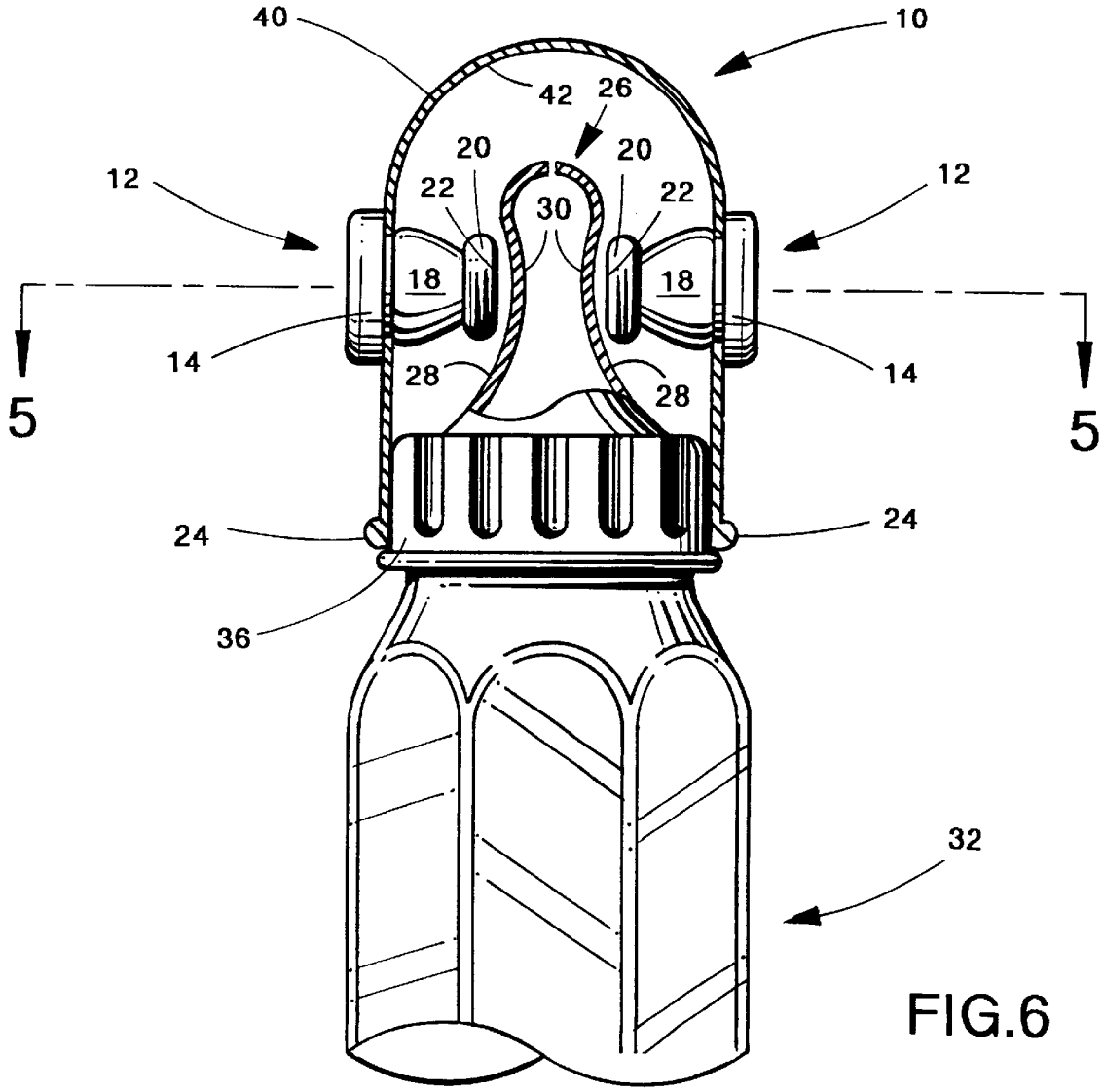
FIG. 6 is a cut-away elevation view of the preferred embodiment of the invention in its open position.

Referring to the Figures, and more specifically FIG. 3, FIG. 4 and FIG. 6, the invention consists of bottle cap 10 and two plugs 12 contained within and at the base of the bottle cap 10. The bottle cap 10 can be made to fit any standard baby bottle 32. The bottle cap 10 may be made of a flexible material with the preferred embodiment being a flexible rubber based material with sufficient elasticity to be able to return the bottle cap 10 from its closed position to its open position. The bottle cap 10 has a base 24, an outer surface 40 and an inner surface 42. Contained within the bottle cap 10 is an inner cavity 38 designed to accept the nipple 26 of the baby bottle 32. At the bottom of the bottle cap 10 is an open end 34.

Each of the plugs 12 consists of a head 14, a stem 18, and an end 20. The plugs 12 are located on opposite sides of the bottle cap 10 and are aligned along the same axis. The plugs 12 are separated by a sufficient space so that they do not touch the nipple 26 when the bottle cap 10 is placed on the baby bottle 32. The plugs 12 may be made of any solid material with the preferred embodiment being a hard rubber based material. The plugs 12 can be manufactured as part of the bottle cap 10 or manufactured separately and pressed into the bottle cap 10 using standard pressing techniques. If the plugs 12 and the bottle cap 10 are manufactured as one piece, the stems 18 and ends 20 of the plugs 12 become in effect an extension of the inner wall 42 of the bottle cap 10.

Each head 14 of the plugs 12 has an outer surface 16 designed to be used during operation. Each end 20 of the plugs 12 has a surface 22 designed to interface with the outer surface 28 of the nipple 26 during operation of the invention.

Figure 5:
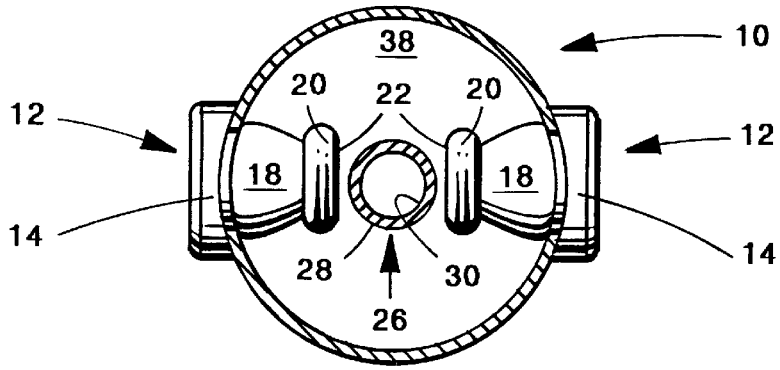
FIG. 5 is a cut-away plan view of the preferred embodiment of the invention in its open position.
Figure 7:
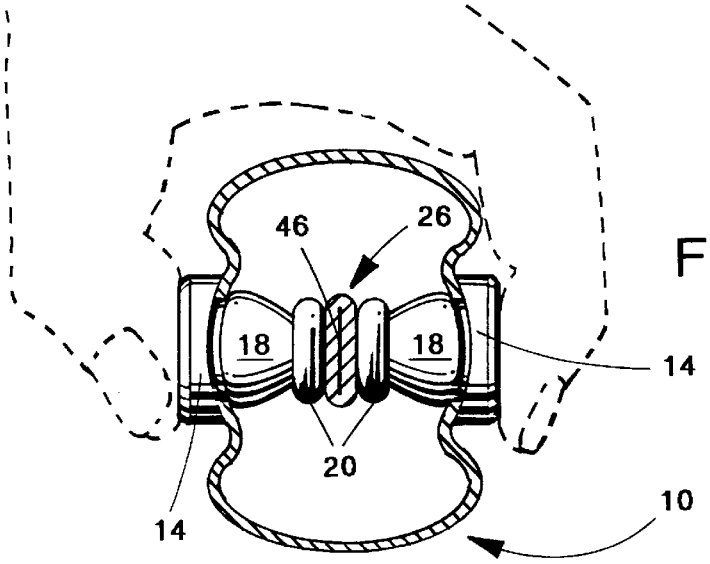
FIG. 7 is a cut-away plan view of the preferred embodiment in its sealed position.
Figure 8:
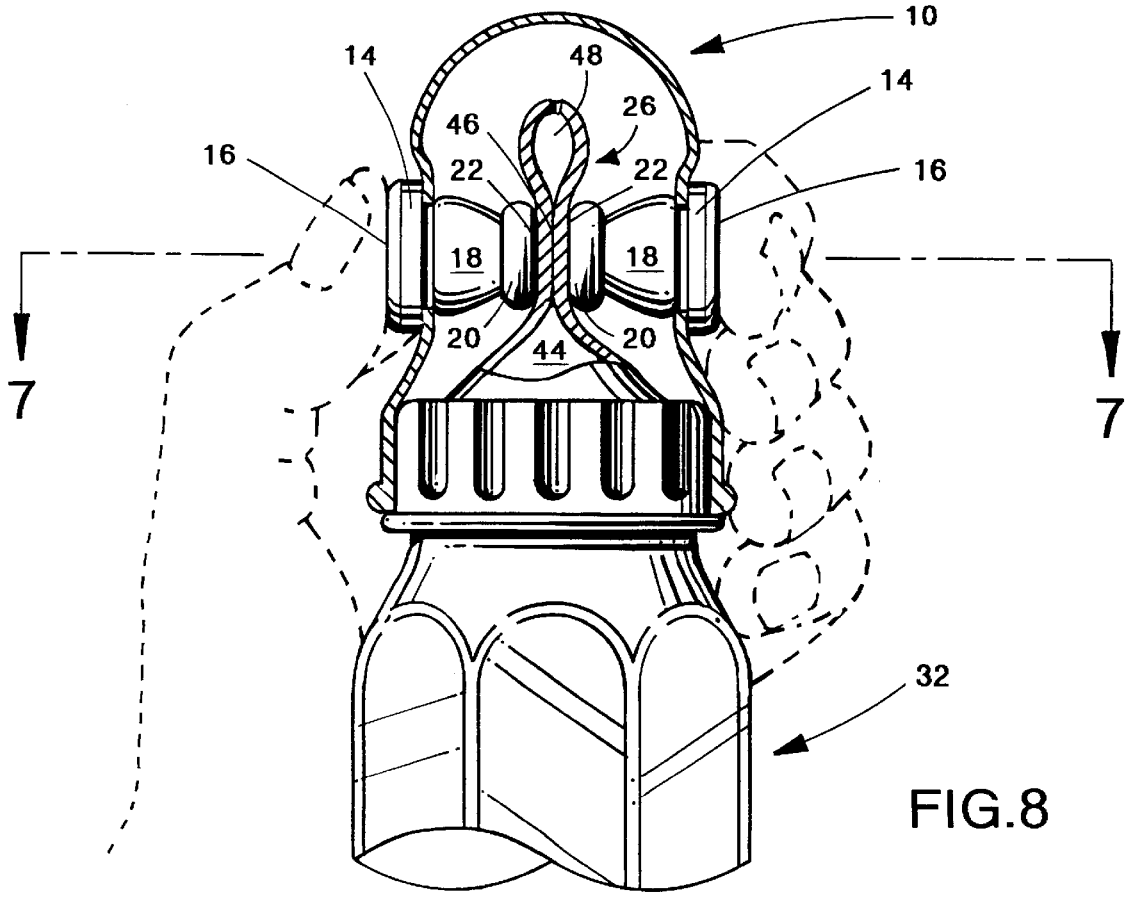
FIG. 8 is a cut-away elevation view of the preferred embodiment in its sealed position.

To operate the invention, one must first place the powder baby formula and water into the baby bottle 32 and then connect the nipple 26 to said bottle. The nipple 26 is typically connected to the baby bottle 32 using a nipple collar 36 that is typically a threaded sealing collar. The typical nipple 26 is made of a flexible material possessing inherent elasticity. The bottle cap 10 is then placed onto the baby bottle 32 with the preferred embodiment being a snug-fit in which the base 24 of the bottle cap 10 fits annularly around the nipple collar 36. The plugs 12 are sufficiently spaced apart so that they do not touch the head of the nipple during the placement of the bottle cap 10 on to the baby bottle 32. The invention is now in its passive or open position (see FIG. 5 and FIG. 6). At this point the plugs 12 are not touching the nipple 26 and are axially aligned with the neck of the nipple 26. Just prior to mixing the baby formula, one operates the invention to its sealed position (see FIG. 7 and FIG. 8). To operate the invention one applies pressure, typically through the use of a thumb and index finger of the same hand, to the surfaces 16 of the heads 14. The plugs 12 are then moved axially toward each other causing the walls of the bottle cap 10 to deflect inwardly. The axial movement of the plugs 12 also causes the surfaces 22 of the ends 20 to come in contact with the outer surface 28 of the nipple 26. When the plugs 12 are continued in an axial movement together they cause the nipple 26 to be pinched. Consequently, the inner surfaces 30 of the nipple 26 meet creating the seal 46 (See FIG. 7). The invention is now in its sealed or closed position. One is now able to mix the baby formula which is typically done by shaking the baby bottle 32.

The seal 46 splits the inner cavity of the nipple 26 into a sealed portion 48 and an unsealed portion 44. The seal 46 prevents the formula from entering the sealed portion 48 of the nipple 26. Consequently, the formula can not reach the tip of the nipple during mixing. As a result, the nipple 26 can not become clogged with the formula during the mixing of the same. Once the formula is fully mixed, the pressure on the plugs 12 is removed causing the invention to return to its passive or open position. The elasticities of the nipple 26 and of the rubber based bottle cap 10 cause the invention to return to its open position. The bottle cap 10 is then removed from the baby bottle 32 revealing an unclogged and free flowing nipple 26. The baby bottle 32 can then be used as normal. The nipple 26 remains sterile since one did not have to unclog the nipple 26 with her hands or fingers.

What is claimed is:

1. A free flow formula cap comprising:

a cap comprising an outer and inner surface, an internal cavity, an open end and a base;

two plugs with each plug comprising a head, a stem and an end;

where each end and stem of said plugs are contained within and near the base of said cap;

where each end of the plugs comprises an outer surface designed to interface with a nipple of a baby bottle;

where each head of the plugs is disposed near the base and on the outer surface of the cap and where each said head comprises an outer surface designed to provide a means to axially move said plugs;

where each plug is axially aligned with the other respective plug;

where the plug and cap assembly is sized to fit on any standard baby bottle and designed not to touch the nipple prior to clamping;

where said plugs provide a means for clamping and sealing a nipple of a baby bottle.

2. A free flow formula cap as is claim 1 wherein said cap is made of a flexible rubber based material and said plugs are made of a solid rubber based material.

3. A free flow formula cap as is claim 1 wherein the plugs and the cap are manufactured as one piece resulting in said plugs becoming an extension of the inner surface of said cap.

* * * * *